US005890825A

United States Patent [19]

Kageyama et al.

[11] Patent Number: 5,890,825

[45] Date of Patent: Apr. 6, 1999

[54] COMPOSITE WRITING INSTRUMENT

[75] Inventors: Hidehei Kageyama; Yoshio Noguchi, both of Kawagoe; Seiichi Kobayashi; Naoki Sekuguchi, both of Kanagawa-ken, all of Japan

[73] Assignee: Kotobuki & Co., Ltd., Kyoto, Japan

[21] Appl. No.: 821,407

[22] Filed: Mar. 21, 1997

Related U.S. Application Data

[63] Continuation of Ser. No. 352,059, Nov. 30, 1994, abandoned.

[30] Foreign Application Priority Data

Jul. 22, 1994 [JP] Japan ..... 6-191207

[51] Int. Cl.[6] ..... B43K 29/02; B43K 27/00

[52] U.S. Cl. ..... 401/52; 401/29; 401/32

[58] Field of Search ..... 401/52, 29, 30, 401/31, 32, 33

[56] References Cited

U.S. PATENT DOCUMENTS

| | | | |
|---|---|---|---|
| 4,227,822 | 10/1980 | Kokubu . | |
| 5,306,085 | 4/1994 | Kobayashi . | |
| 5,306,107 | 4/1994 | Kageyama et al. . | |
| 5,662,425 | 9/1997 | Mitsuya | 401/52 X |

FOREIGN PATENT DOCUMENTS

| | | | |
|---|---|---|---|
| 1461335 | 4/1969 | Germany | 401/30 |
| 2400387 | 7/1975 | Germany | 401/30 |
| 228077 | 7/1990 | Japan | 401/29 |
| 3397 | 1/1991 | Japan | 401/52 |
| 615748 | 4/1994 | Japan | 401/29 |

*Primary Examiner*—Steven A. Bratlie

*Attorney, Agent, or Firm*—Rothwell, Figg, Ernst, & Kurz, P.C.

[57] ABSTRACT

A composite writing instrument comprising a writing instrument mechanism having a plurality of refills and a rod-like delivery mechanism, the composite writing instrument comprising middle shaft provided between a front shaft and a rear shaft, return springs having one end terminated at the middle shaft to urge the refills, respectively, backward; sliding cams mounted at rear portions of the refills and terminated at the other ends of the return springs to be urged backward, a cam body having at a front portion a cam operating portion which presses the rear end of either of the sliding cams to selectively advance the refills; a guide tube rotatably engaging the cam body and having a guide groove in the axial direction; a slider formed in the guide tube holding a rod-like article and being slidable in the axial direction along the guide groove of the guide tube, the cam body being provided with an engaging portion which engages the middle shaft so as to be slidable in the direction of the front shaft and be rotatable, the cam body further being formed with a helical groove in an inner periphery at the rear portion thereof, and the slider being provided with an engaging projection in engagement with the helical groove of the cam body, whereby the rotation of the cam body is controlled about the middle shaft by engagement of an engaging piece formed at the rear end of the middle shaft and a projection of the cam body.

7 Claims, 10 Drawing Sheets

COMPOSITE WRITING INSTRUMENT

This is a continuation of application Ser. No. 08/352,059, filed Nov. 30, 1994 now abandoned.

BACKGROUND OF THE INVENTION

1. Field of the Invention

This invention relates to a composite writing instrument provided with a plurality of writing members and a mechanism for delivering a rod-like article such as an India rubber.

2. Prior Art

In the past, there has been proposed a composite writing instrument in which a plurality of writing members, for example, a mechanical pencil element and a ball point pen element are received into a single tube in the front portion. Such a composite writing instrument is disclosed in, for example, U.S. Pat. No. 4,227,822. The conventional writing instrument has a sleeve-like operating cam in engagement with a slider and two guide grooves which axially extend and diametrically oppose each other, wherein a mechanical pencil element and a ball point element are selectively used by a guide secured to the rear end of a shaft case.

SUMMARY OF THE INVENTION

However, these constructions are complicated and fail to secure a space for the provision of a mechanism for delivering a rod-like article such as an India rubber at a rear portion thereof. On the other hand, the demand for such a multifunctional writing instrument is increasing as the need for increased speed and accuracy in clerical work has increased in view of the foregoing, it is an object of this invention to provide a composite writing instrument which is easy to control and manipulate.

It is a further object of this invention to provide a composite writing instrument which can simply replenish lead of a mechanical pencil and replace rod-like articles such as, for example, a ball point pen and an India rubber to improve controllability. In particular, it is another object of this invention to provide a writing instrument in which a short ball point pen refill can be used and a residual portion, that is, a loss portion of a rod-like article such as an India rubber, can be minimized.

For achieving the aforementioned objects, according to the present invention there is provided a composite writing instrument comprising a writing instrument mechanism having a plurality of refills and a rod-like delivery mechanism, said composite writing instrument comprising: a middle shaft provided between a front shaft and a rear shaft; return springs having one end terminated at said middle shaft to bias said refills, respectively, backward; sliding cams mounted at rear portions of said refills and terminated at the other ends of said return springs to be biased backward; a cam body having at a front portion a cam operating portion which presses the rear end of either of said sliding cams to selectively advance said refills, and comprising an engaging portion engaged with said middle shaft so that said engaging portion is slidably moved in the direction of said front shaft and is rotatable, said cam body being formed with a helical groove in an inner periphery at the rear portion thereof; a guide tube fitted rotatably with said cam body and formed with a guide groove in the axial direction; and a slider provided within said guide tube and comprising an engaging projection in engagement with the helical groove of said cam body, said slider holding a rod-like article and being slidable in the axial direction along the guide groove of the guide tube.

When the rear shaft is rotated, either refill is selected and projected by the operating portion of the cam body. When the selected refill is for a mechanical pencil, the rear end of the rear shaft is knocked to deliver lead. When a rod-like article such as an India rubber is used, the operating portion at the rear end of the guide tube is held and rotated, the slider is moved upward while being guided by the helical groove of the cam body and the guide groove of the guide tube so that an India rubber or the like is delivered from the rear end.

PREFERRED EMBODIMENTS

Figure 1:
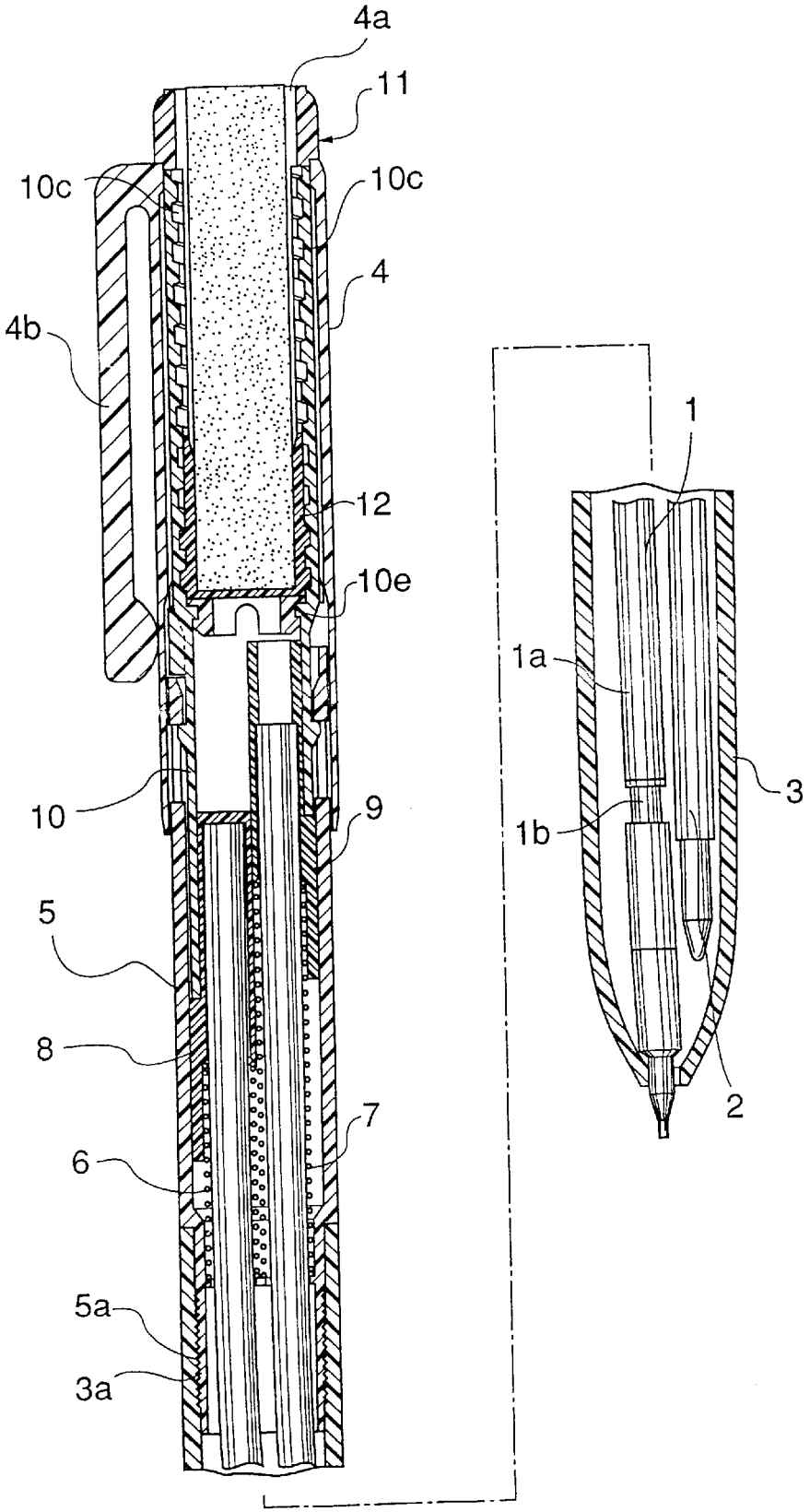
FIG. 1 is a longitudinal sectional view with a part of a composite writing instrument omitted showing one embodiment of this invention.

An embodiment of this invention will be described in detail hereinbelow with reference to the accompanying drawings. FIG. 1 shows a composite writing instrument which is provided at a front portion with a writing instrument mechanism having a composite function including a plurality of refills, one being a mechanical pencil refill and the other being a ball point pen refill 2, and at a rear portion with a rod-like article delivery mechanism, which is in this case, an India rubber delivery mechanism.

Figure 2:
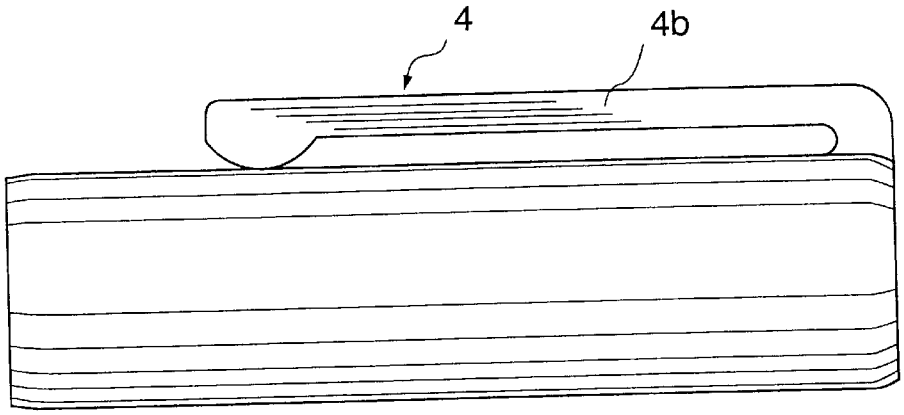
FIG. 2 is a side view of a rear shaft shown in FIG. 1.
Figure 3:
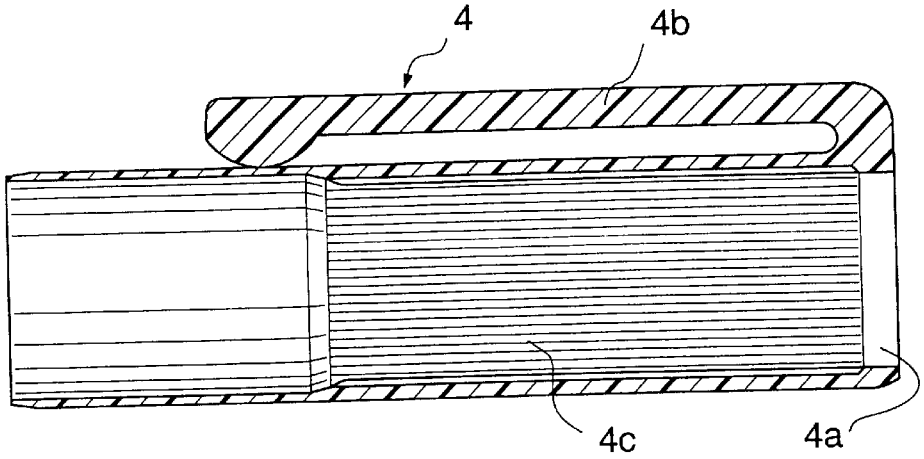
FIG. 3 is a longitudinal sectional view of the rear shaft shown in FIG. 2.

This writing instrument comprises a front shaft 3 for receiving a writing instrument mechanism portion positioned at a front portion and a rear shaft 4 for receiving the India rubber delivery mechanism posited at a rear portion. Internal threads 3*a* are formed in the inner periphery at the rear portion of the front shaft 3. As shown in FIGS. 2 and 3, the rear shaft 4 is formed at the rear end with an opening 4*a* through which an India rubber is delivered, which is described later, and a portion adjacent to the opening 4*a* comprises a base in which a clip 4*b* is integrally provided. In the inner peripheral surface of the rear shaft 4 is axially formed a number of notches 4*c* for rotation resistance.

Figure 4:
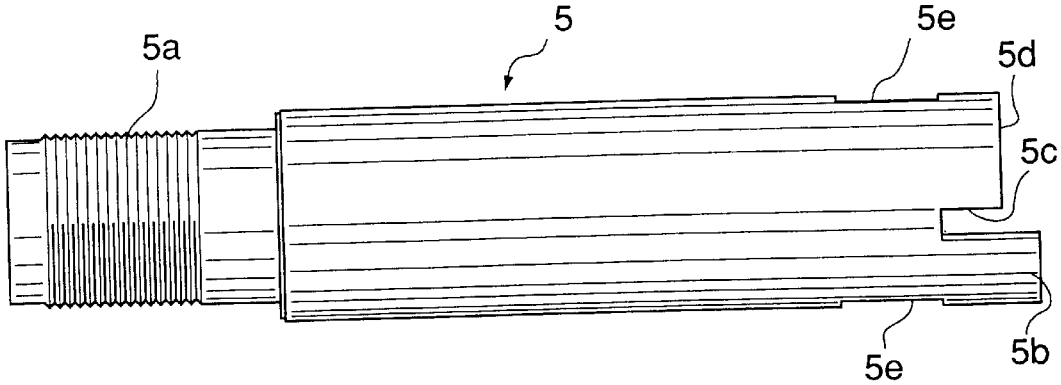
FIG. 4 is a side view of a middle shaft shown in FIG. 1.
Figure 5:
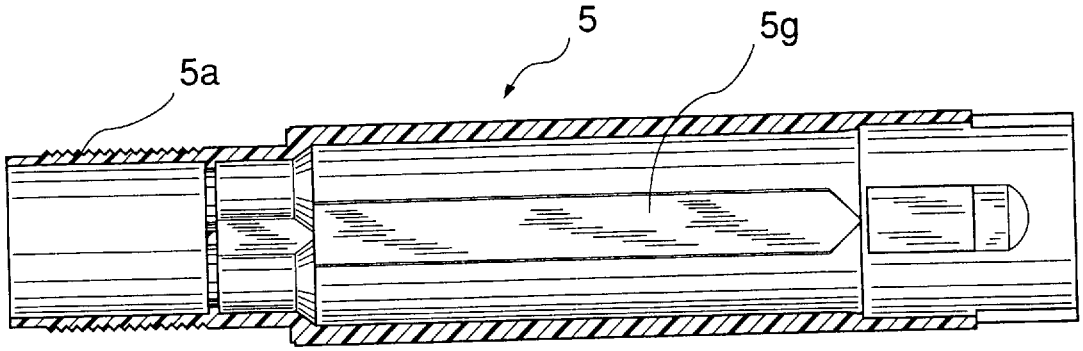
FIG. 5 is a longitudinal sectional view of the middle shaft shown in FIG. 4.
Figure 6:
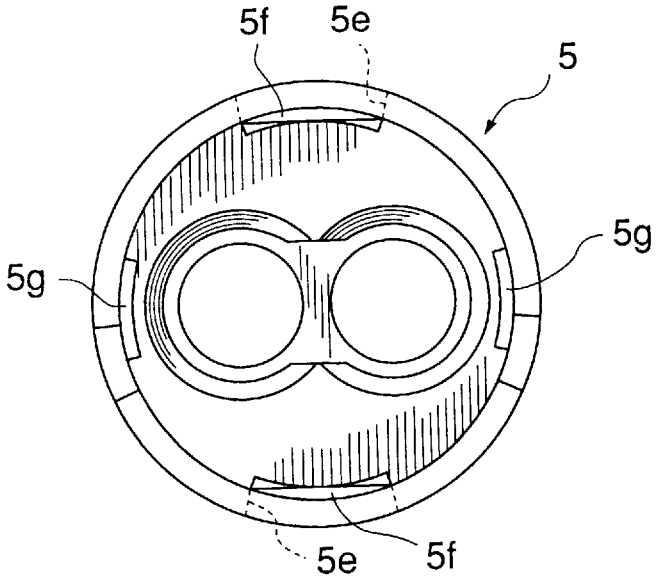
FIG. 6 is a plan view of the middle shaft shown in FIG. 4.
Figure 7:
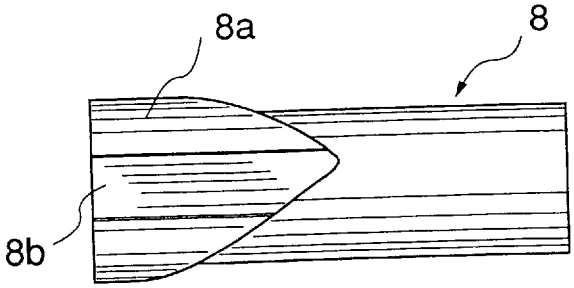
FIG. 7 is a front view of a sliding cam for a refill of a mechanical pencil shown in FIG. 1.
Figure 8:
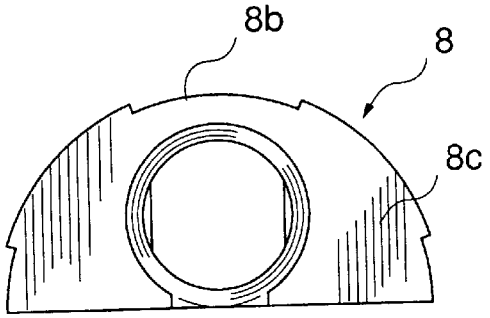
FIG. 8 is an enlarged plan view of the sliding cam shown in FIG. 7.

A middle shaft is interposed between the front shaft 3 and the rear shaft 4. As shown in FIGS. 4 to 6, external threads 5*a* are formed in a small-diameter portion at the end of the middle shaft 5, and the external threads 5*a* are meshed with the internal threads 3*a* of the front shaft 3, which is removed when necessary to replenish or replace lead for the mechanical pencil. An engaging piece 5*b* for a stopper is provided integral with the rear end of the middle shaft 5, and two cuts 5*c* which function as knocking allowances after assembled are axially formed on opposite ends of the engaging piece 5*b*.

Between these cuts 5*c* is formed an intermediate guide portion 5*d* at an intermediate level between the upper side of the engaging piece and the bottom side of the cut 5*c*. A projection 10*b* of a cam body 10 described later moves in the diametral direction from one cut 5*c* to the other cut 5*c* via the intermediate guide portion 5*d*, and when the projection 10*b* reaches either cut 5*c*, the refills 1 and 2 are selectively delivered. If the selected refill 1 is for a mechanical pencil, it is knocked and axially moves within the cut 5*c* to deliver lead.

Through-holes 5*e* are bored in a pair of thick-walled portions 5*f* opposite to the rear portion of the middle shaft 5 and a rib 5*g* for guide opposite to the inner peripheral portion of the middle shaft 5 is axially formed.

One end of return springs 6 and 7 for biasing the refills 1 and 2 backward is terminated at the front portion of the middle shaft 5. Sliding cams 8 and 9 are mounted at the rear portions of the refills 1 and 2 and the sliding cams 8 and 9 are terminated at the other ends of the return springs 6 and 7 and biased backward. The sliding cams 8 and 9 have at their front portions cam operating portions 8*a* and 9*a* for pressing the rear end of either the refill 1 or 2 to selectively advance them, as shown in FIGS. 7 to 12.

Figure 9:
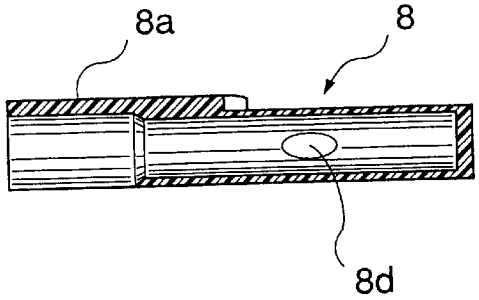
FIG. 9 is a longitudinal sectional view of the sliding cam shown in FIG. 7.
Figure 10:
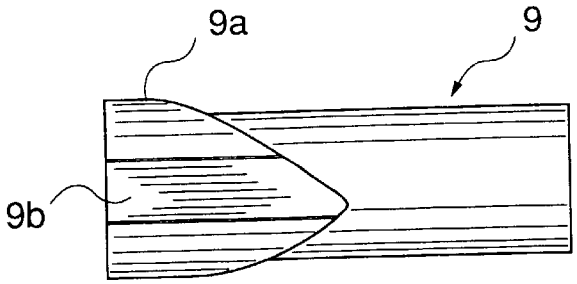
FIG. 10 is a front view of a sliding cam for a refill of a ball point pen shown in FIG. 1.
Figure 11:
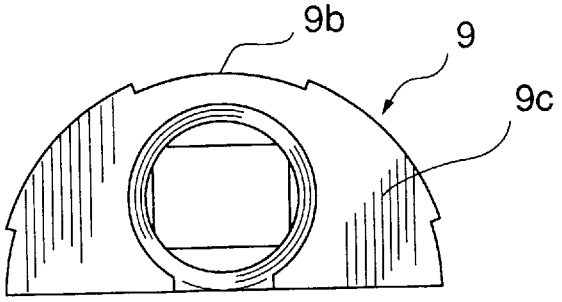
FIG. 11 is an enlarged plan view of the sliding cam shown in FIG. 10.
Figure 12:
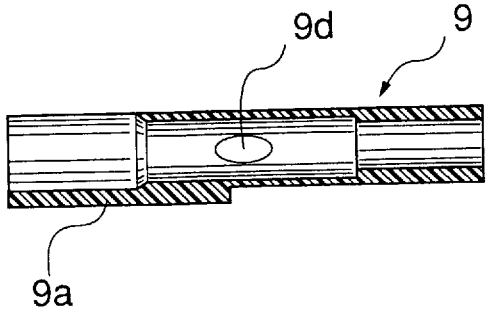
FIG. 12 is a longitudinal sectional view of the sliding cam shown in FIG. 10.

Further, recesses 8*b* and 9*b* provided in the cam operating portions 8*a* and 9*a* are engaged with the rib 5*g* for guide provided inside of the middle shaft 5 to make the vertical movement of the sliding cams 8 and 9 smooth. At the rear portions of the sliding cams 8 and 9 are provided D-shaped portions 8*c* and 9*c* which are slidably inserted internally of the front end of the cam body 10. Accordingly, this has an advantage such that complicated structures are not necessary such as, for example, the sleeve-like operating cam in engagement with the slider, the two guide grooves which axially extend and diametrally oppose each other, and the guide secured to the rear end of the shaft case as disclosed in the abovementioned U.S. Pat. No. 4,227,822. In FIGS. 9 and 12, reference numerals 8*d* and 9*d* denote fitting adjusting projections for adjusting unevenness of pipe-diameter of the refills prepared by extrusion molding.

Figure 13:
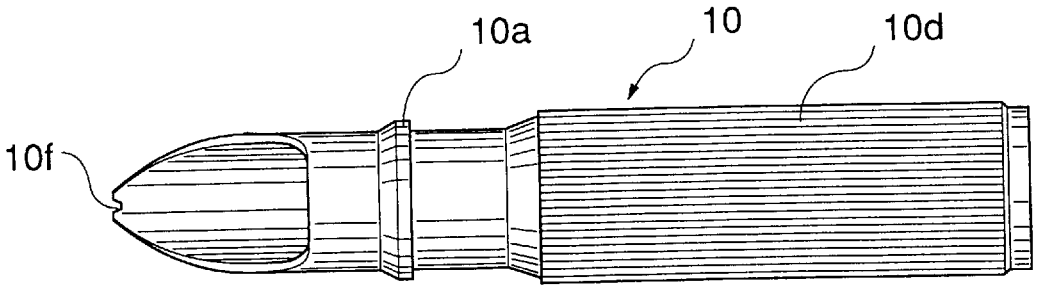
FIG. 13 is a front view of a cam body shown in FIG. 1.
Figure 14:
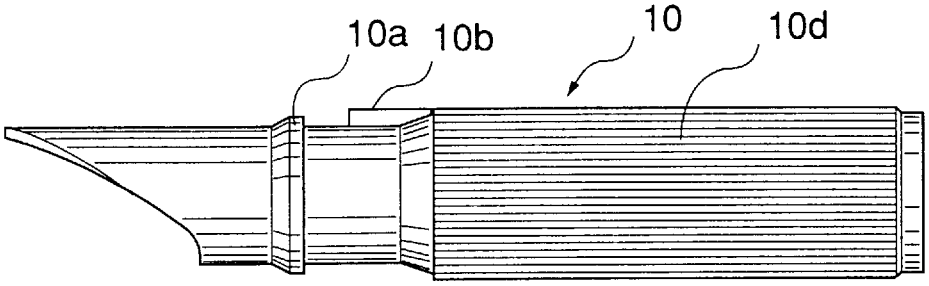
FIG. 14 is a side view of the cam body shown in FIG. 13.
Figure 15:
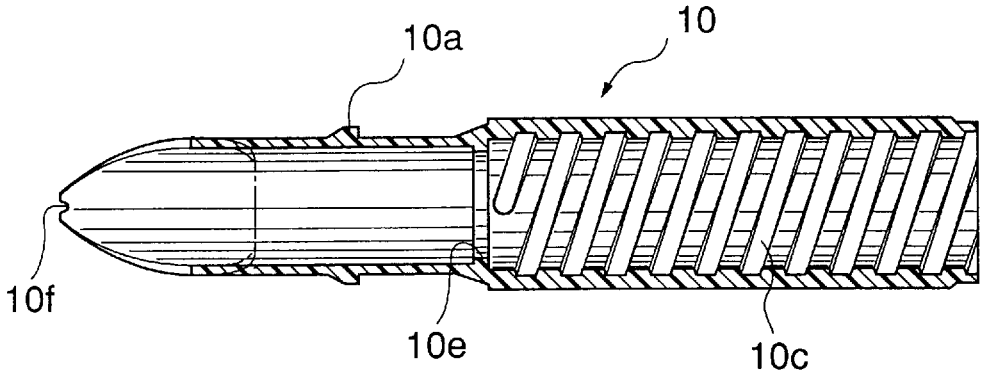
FIG. 15 is a longitudinal sectional view of the cam body shown in FIG. 13.
Figure 16:
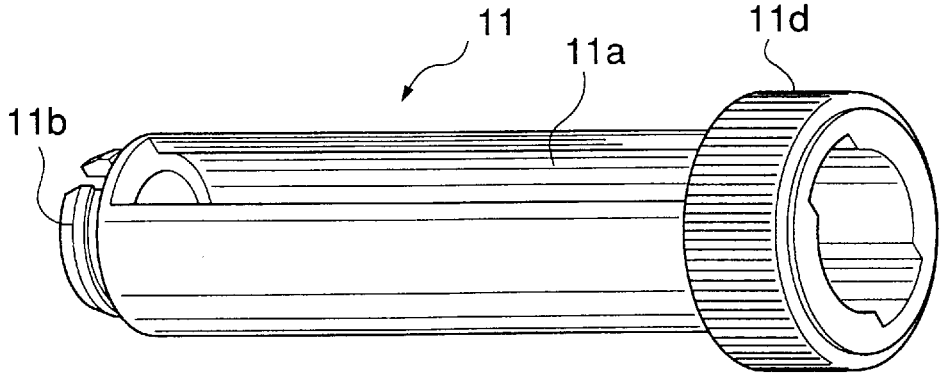
FIG. 16 is a perspective view of a guide tube shown in FIG. 1.
Figure 17:
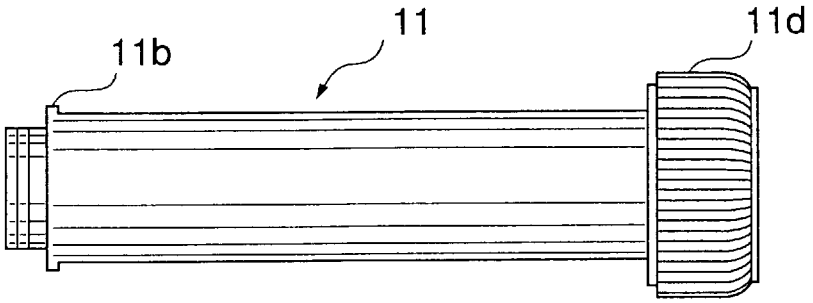
FIG. 17 is a front view of the guide tube shown in FIG. 16.
Figure 18:
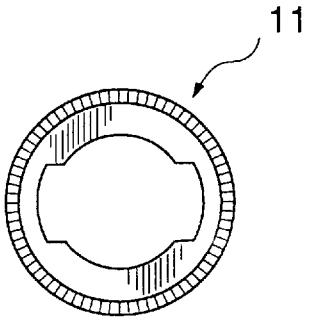
FIG. 18 is a plan view of the guide tube shown in FIG. 16.
Figure 19:
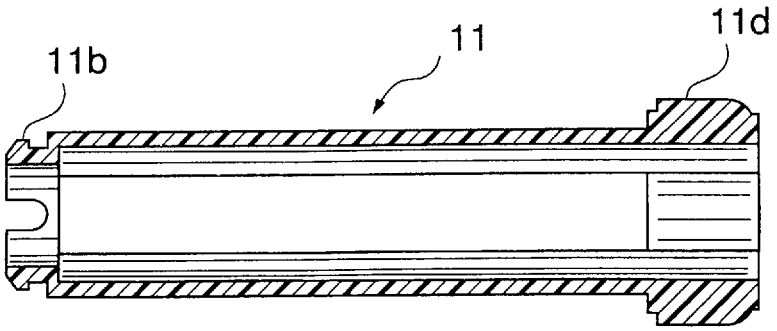
FIG. 19 is a longitudinal sectional view of the guide tube shown in FIG. 16.

Next, as shown in FIGS. 13 to 15, the cam body 10 is provided at its outer periphery with a ring-like engaging projection 10*a* which is engaged with the middle shaft 5 and slidably moved in the direction of the front shaft 3 and made rotatable. More specifically, since the through-holes 5*e* are bored in a pair of thick-walled portions 5*f* opposite to the rear portion of the middle shaft 5, when the front portion of the cam body 10 is inserted under pressure into the middle shaft 5, the ring-like engaging projection 10*a* forces the thick-walled portion 5*f* to open when inserted and moves into the through-hole 5*e* and is rotatably fitted, it being slidable in the forward direction but being locked in the backward direction.

The cam body 10 is rotatable relative to the middle shaft 5. A stopper projection 10*b* is axially formed on the front outer wall of the cam body 10. This stopper projection 10*b* is limited in its rotational direction by the engaging piece 5*b* projected backward of the middle shaft 5 so that the stopper projection 10*b* does not fully rotate but merely rotates at an angle enough to select the sliding cams 8 and 9 (i.e., between one end edge and the other end edge of the engaging piece 5*b*).

Further, the cam body 10 is formed in its rear inner periphery with two helical grooves 10*c*. Due to the provision of the two helical grooves 10*c*, there exists the advantages such that, as described later, the slider 12 can be moved up to the highest level in a stable manner, the loss of a residual India rubber can be minimized, and the removal of a residual India rubber and the mounting of a new India rubber can be performed simply. Further, the cam body 10 is formed at its rear outer periphery with notches 10*d* which engage the notches 4*c* formed in the inner periphery of the rear shaft 4 as described above to perform the function of the rotation-resistance. Further, by the provision of a fitting projection 10*e* provided inside the cam body 10, a guide tube 11 described later can rotate but cannot be pulled out in the axial direction.

Preferably, the cam body 10 has its outside diameter which is formed to be gradually smaller backward so that the cam body 10 can be easily inserted from the front portion of the rear shaft 4 when assembled. Further, in place of the notches 10*d* of the cam body 10, a polygonal shape can be employed and a configuration capable of merely being inserted under pressure can be used. In the drawing, reference numeral 10*f* designates a stop portion formed at the apex of the cam operating portion of the front portion of the cam body 10.

The guide tube 11 is rotatably fitted in the cam body 10 and is formed at the side wall thereof with an axially opposing long guide groove 11*a*. As is clear from FIGS. 16 to 19, at the end of the guide tube 11 is provided a stopping projection 11*b* in engagement with a fitting projection 10*e* projected inwardly of the cam body 10. Further, at the rear end of the guide tube 11 is formed a large diameter rotation operating portion 11*d* which is exposed from the rear end of the rear shaft 4 when assembled to deliver an India rubber. Knurling may be provided as shown to facilitate the operation of the rotation operating portion 11*d*.

Figure 20:
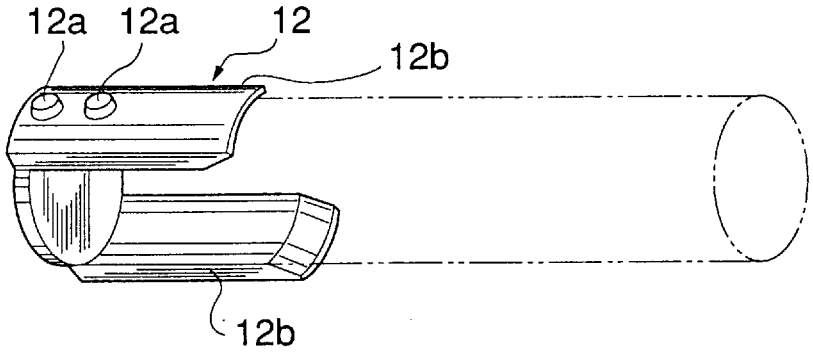
FIG. 20 is a perspective view of a slider shown in FIG. 1.
Figure 21:
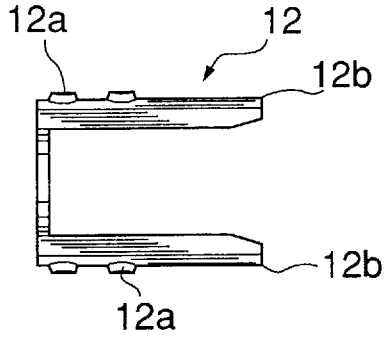
FIG. 21 is a side view of the slider shown in FIG. 20)
Figure 22:
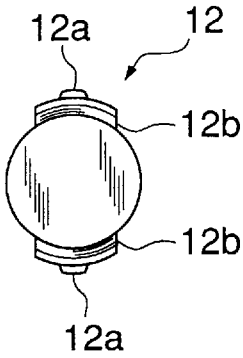
FIG. 22 is a plan view of the slider shown in FIG. 20)

As shown in FIGS. 20 to 22, the slider 12 is provided with two pairs of engaging projections 12*a* provided inside the guide tube 11 and in engagement with the helical groove 10*c* of the cam body 10, and can slide axially along the guide groove 11*a* of the guide tube 11 while holding a rod-like article such as an India rubber. This slider 12 has a pair of arm portions 12*b* which are axially extended so that the receiving side thereof for receiving a rod-like article such as an India rubber is flexed inwardly. Accordingly, since the slider can be easily inserted and set from the front end of the guide tube 11 by inwardly flexing the arm portions 12*b*, the operability of the writing instrument is excellent.

The operation of the composite writing instrument according to the present invention will be described hereinbelow. First, the lead of the mechanical pencil is projected in the procedure as follows. The rear shaft 4 is rotated, and the refill 1 of the mechanical pencil is selected by the operating portion of the cam body 10 to project the refill 1. After this, the rear end of the writing instrument is knocked, the cam body 10 is then advanced, and the lead tank 1*a* is also advanced through the sliding cam 8. At this time, a chuck (not shown) within the refill 1 is released from a chuck ring to deliver the lead. When knocking is stopped, the chuck is again moved back into engagement with the chuck ring so as to secure the lead to provide an instrument capable of producing writing.

When an India rubber is desired during writing, the large diameter rotation operating portion 11*d* at the rear end of the guide tube 11 is held and rotated relative to the rear shaft 4. Then, the slider 12 rotates along with the guide tube 11 and is guided in the helical groove 10*c* of the cam body 10 whereby the slider 12 moves upward along the guide groove 11*a* of the guide tube 11 so that the India rubber can be delivered from the rear end. When the India rubber is withdrawn after use, the large diameter rotation operating portion 11*d* at the rear end of the guide tube 11 is held and rotated in a direction opposite to the direction of rotation made so as to deliver the India rubber. After the withdrawal of the India rubber, the rear shaft 4 is reversely rotated so that the mechanical pencil is also withdrawn.

On the other hand, when the writing instrument is used as ball point pen, if the rear shaft 4 is rotated in a direction opposite to that when the refill 1 of the mechanical pencil is projected, the refill 2 for a ball point pen is advanced by the cam operating portion formed at the front portion of the cam body 10 and is projected from the opening of the front shaft 3 to provide an instrument capable of producing writing. After use, when the rear shaft 4 is reversely rotated it is possible to readily retract the refill 1 into the writing instrument.

The replenishment of lead for a mechanical pencil and the replacement of refills for a ball point pen can be easily accomplished by turning the front shaft 3 to release the engagement thereof with the middle shaft 4 to remove the front shaft 3. The external threads 5*a* are formed in the small diameter portion at the end of the middle shaft 5 and the external threads are engaged with the internal threads 3*a* of the front shaft 3. The front shaft 3 is disengaged and removed from the middle shaft 4 so that the lead for the mechanical pencil can be replenished or replaced. Thus, the cumbersomeness of prior art composite writing instruments in which a whole rod-like article delivery mechanism at the rear portion is removed and a piece of lead or the like is replenished from the rear end is eliminated.

At least one refill 1 out of the plurality of refills 1 and 2 is formed integral with the sliding cam 8. That is, at least one of the plurality of refills 1 and 2 is the refill 1 for a mechanical pencil. The lead tank 1*a* constituting the refill 1 is formed integral with the sliding cam 8 and the pencil point 1*b* is removably inserted under pressure into the lead tank 1*a*. Thus, when lead is replenished, the pencil point 1*b* is removed and the lead can be replenished into the lead tank 1*a* to avoid possible breakage of the lead. Further, a pipe-like connector integral with the sliding cam 9 is formed at the rear of the refill 2 for a ball point pen whereby a short refill for a ball point pen can be inserted into the connector.

Figure 23:
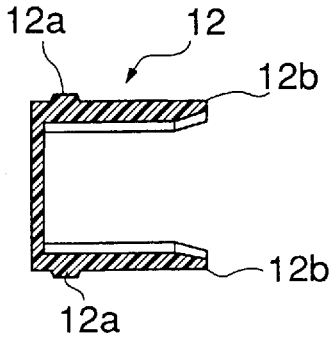
FIG. 23 is a longitudinal sectional view of a modified example of the slider shown in FIG. 20.

FIG. 23 shows a modified example of the slider 12 shown in FIG. 20. The slider 12 in the instant example is formed to have an axial length which is shorter than that shown in FIG. 20. Only a single pair of projections 12*a* in engagement with the two helical grooves 10*c* is formed at the demeter corresponding position. Thus, according to this modified example, the distance from the base end of the arm portion 12*b* of the slider 12 to the projection 12*a* at the uppermost level is shorter than the slider 12 having a pair of projections obliquely provided in the single helical groove in the prior art or the two pairs of projections 12*a* shown in FIG. 20, thus enabling the reduction in the unusable portion of an India rubber. In the projection 12*b* of the slider 12 according to the present invention, two helical grooves 10*c* of the cam body 10 are provided such that the vertical movement of the slider 12 is stable and is twice as fast as an instrument having a single helical groove assuming the same rotational operating amount is involved.

Figure 24:
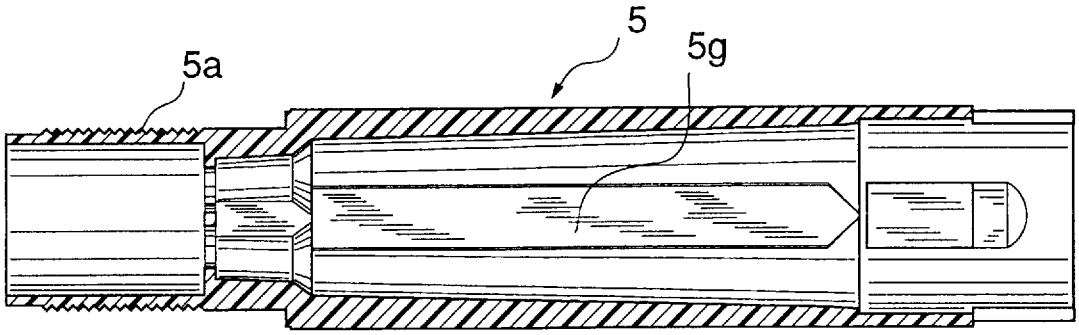
FIG. 24 is a longitudinal sectional view of a modified example of the middle shaft shown in FIG. 4.
Figure 25:
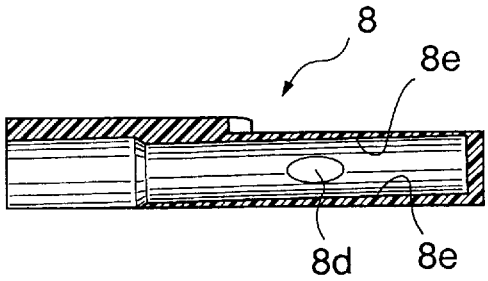
FIG. 25 is a longitudinal sectional view of a modified example of the sliding cam for a refill for a mechanical pen shown 12 in FIG. 7.
Figure 26:
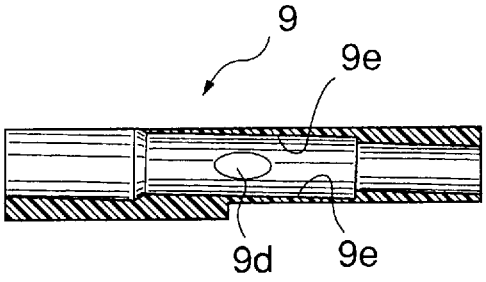
FIG. 26 is a longitudinal sectional view of a modified example of the sliding cam for a refill for a ball point pen shown in FIG. 10.

FIG. 24 shows a modified example of the middle shaft 5. In this example, the inside diameter of the middle shaft 5 is formed to become gradually smaller forwardly, and when the refills 1 and 2 are extruded, the tips thereof are urged in the direction of the diametrically central part. Further, as shown in FIGS. 25 and 26, when the sliding cams 8 and 9 are molded, a core pin falls in the direction of the diametrically central part so that the inner walls 8*e* and 9*e* of the sliding cams 8 and 9 into which the refills 1 and 2 are inserted are inclined in the direction of the diametrically central part. When the refills 1 and 2 are extruded, the tips thereof are urged in the direction of the diametrically central part such that when the refills 1 and 2 are extruded, the tips thereof can be smoothly projected from the opening of the front shaft 3.

Figure 27:
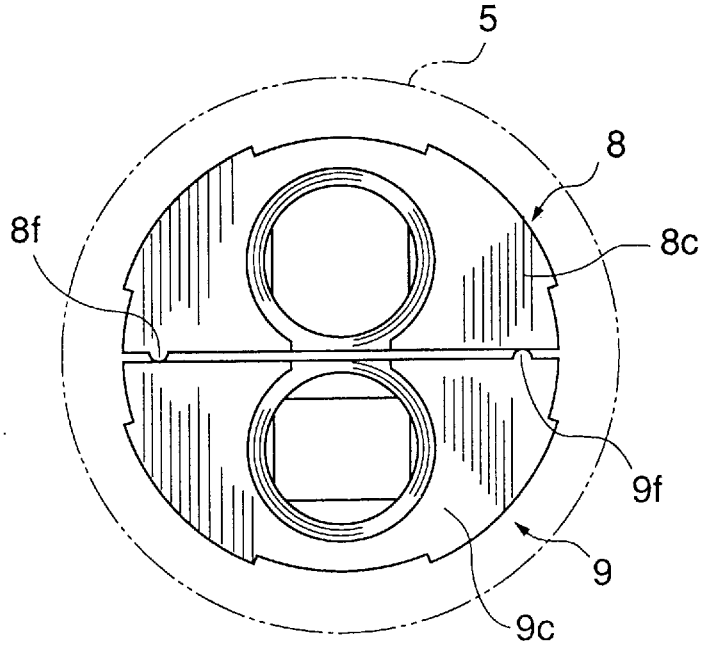
FIG. 27 is a plan view showing the state where a further modified example of the sliding cam shown in FIGS. 7 and 10 is set inside of the middle shaft.

FIG. 27 shows a modified example of the sliding cams 8 and 9. Reference numerals 8*f* and 9*f* denote ribs for a side guide. These ribs 8*f* and 9*f* are constructed such that when the sliding cams 8 and 9 are set within the cam body 10 with their planes opposed to each other, the outside diameter, having a circular section, matches the inner periphery of the round shape of the cam body 10. As a result of the presence of the ribs 8*f* and 9*f*, the sliding cams 8 and 9 have a reduced frictional area and play relative to the inner wall of the cam body is eliminated, thus providing smooth vertical movement.

While in the above-described embodiment the use of two refills 1 and 2 has been described, it is to be noted that three refills or more can be used and that other rod-like articles such as color lead, a correction rod or the like other than India rubber can be also included.

The present invention provides a useful composite writing instrument comprising a plurality of writing members and a mechanism for delivering a rod-like article such as an India rubber at the rear portion in which replenishment of lead and replacement of refills for a ball point pen and a rod-like article such as an India rubber are made in a simple manner to improve controllability of the instrument.

What is claimed is:

1. A composite writing instrument having a plurality of rod-like writing members, said composite writing instrument comprising:

a generally cylindrical forward shaft portion in which said rod-like writing members are longitudinally disposed, at least one of said rod-like writing members having a sliding cam member attached at a rear portion thereof, said sliding cam member being axially slidable within said forward shaft portion and said forward shaft portion including means for biasing said rod-like writing members in a rearward direction; and a generally cylindrical rearward cap portion linked to a rear portion of said forward shaft portion, said rearward cap portion having a generally cylindrical cam body coaxially disposed therein, said cam body being axially and rotationally fixed relative to said rearward cap portion;

said cam body having a cam operating portion extending forward from a front portion thereof, said cam operating portion extending forward into the rear portion of said forward shaft portion and engaging said sliding cam member, said cam body and said rear portion of said forward shaft portion being cooperatively configured to permit limited rotational movement of said rearward cap portion relative to said forward shaft portion between first and second angular positions and, while said rearward cap portion is rotated to at least one of said first and second angular positions, to permit limited axial movement of said rearward cap portion relative to said forward shaft portion;

said cam body further having a generally tubular rear portion with a helical groove extending along the inner periphery thereof;

said rearward cap portion further comprising a guide tube coaxially disposed within the rear portion of said cam body, said guide tube being free to rotate by an unlimited amount relative to the rear portion of said cam body and being restrained from moving axially relative to the rear portion of said cam body, said guide tube having a longitudinally extending guide slot;

said rearward cap portion further including a slider for holding a rod-like object, said slider disposed within and axially slidable along said guide tube, said slider having an engaging projection extending through said guide slot and engaging the helical groove extending along the inner periphery of the rear portion of said cam body;

whereby rotation of said rearward cap portion relative to said forward shaft portion, between said first and second angular positions, causes said plurality of rod-like writing instruments to be extended and retracted in alternating fashion, and whereby rotation in alternating directions of said guide tube within the rear portion of said cam body causes said slider to advance and retract within said guide tube while said rearward cap portion remains stationary relative to said forward shaft portion, thereby causing said rod-like object to be extended and retracted in alternating fashion.

2. The composite writing instrument of claim 1, wherein said forward shaft portion has a rib extending longitudinally along an inner surface thereof, said sliding cam member has a recess which engages said rib, and axial movement of said sliding cam member is guided by said rib.

3. The composite writing instrument of claim 1, wherein said cam body has an inner, fitting projection and wherein said guide tube has a stopping projection at a front end thereof, said stopping projection and said fitting projecting being engaged with each other so as to restrain said guide tube from moving axially relative to the rear portion of said cam body while permitting said guide tube to rotate freely by an unlimited amount relative to the rear portion of said cam body.

4. The composite writing instrument of claim 1, wherein said sliding cam member is formed integrally with a corresponding one of said rod-like writing members.

5. The composite writing instrument of claim 1, wherein at least one of said rod-like writing members is a mechanical pencil, said mechanical pencil including a lead tank and said sliding cam member being formed integrally with said lead tank.

6. The composite writing instrument of claim 1, wherein said slider has a receiving side which receives said rod-like object, said receiving side having radially inwardly deformable means for facilitating disposal of said slider within said guide tube.

7. The composite writing instrument of claim 1, further comprising cooperative means on said cam body and said forward shaft portion for preventing relative rotation between said cam body and said forward shaft portion.

* * * * *